United States Patent [19]

Buxton et al.

[11] Patent Number: 5,009,979

[45] Date of Patent: Apr. 23, 1991

[54] ELECTROSTATOGRAPHIC PARTICULATE TONER AND DEVELOPER COMPOSITIONS

[75] Inventors: Galina P. Buxton, Tenafly, N.J.; Kuo-Chang Tang, Cheshire, Conn.

[73] Assignee: Olin Hunt Specialty Products Inc., West Paterson, N.J.

[21] Appl. No.: 425,546

[22] Filed: Oct. 23, 1989

[51] Int. Cl.[5] ..... G03G 9/00; G03G 5/00

[52] U.S. Cl. ..... 430/110; 430/137

[58] Field of Search ..... 430/110

[56] References Cited

U.S. PATENT DOCUMENTS 4,256,824 3/1981 Lu ..... 430/110 X
4,291,112 9/1981 Lu .
4,323,634 4/1982 Jadwin .
4,490,455 12/1984 Hoffend et al. .
4,683,188 7/1987 Suzuki et al. .
4,780,553 10/1988 Suzuki et al. .

FOREIGN PATENT DOCUMENTS 57-111543 7/1982 Japan .

*Primary Examiner*—Marion C. McCamish
*Assistant Examiner*—Steven Crossan

[57] ABSTRACT

A toner composition comprised of resin particles, colorant material and an effect change controlling amount of at least one charge enhancing additive of the formula:

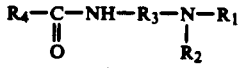

wherein $R_1$ and $R_2$ are lower alkyl groups having 1 to 4 carbon atoms; $R_3$ is a straight-chain alkylene group having from 1 to about 8 carbon atoms; and $R_4$ is an alkyl group having from about 7 to about 24 carbon atoms.

The toners of the present invention are resistant to smearing after fusing onto a suitable substrate, provide good adhesion of the fused image to the substrate, and provide uniform, stable, high net electrical charge on toner particles and work over a wide range of relative humidity.

18 Claims, No Drawings

ELECTROSTATOGRAPHIC PARTICULATE TONER AND DEVELOPER COMPOSITIONS

The present invention relates to electrostatographic particulate toner and developer compositions. In particular, the present invention relates to electrostatographic particulate toner and developer compositions containing a specific class of charge control agents.

Electrostatographic imaging processes have been described extensively in patents and other literature. These processes have in common the forming of an electrostatic charge pattern on an insulating photoconductor. The pattern, or latent electrostatic image, is made visible by contact with a developer containing electrostatically charged toner powder. Several methods of dry development are available, including the well-known magnetic brush and cascade development methods.

Most dry developers are a mixture of toner particles and carrier particles. For magnetic brush development, the carrier particles can be a magnetic substance such as iron filings, powdered iron, or iron oxide. For cascade development and other methods, the carrier particles can be non-magnetic substances such as glass or ceramic beads. The toner particles become triboelectrically charged by frictional contact with the carrier particles. Then, when contacted with the oppositely charged image pattern on the photoconductor, they adhere to the charged area and make the image visible. In well-known office copying machines, the developed toner image is transferred from the photoconductor to a sheet of plain paper to which it is fixed by heat fusing or other known techniques.

The major component of toners is usually a fusible polymeric material. A wide variety of fusible polymeric materials have been used as the polymer component of electrostatic toners. Such polymers include polystyrene, copolymers of styrene and a lower alkyl acrylate or methacrylate, polyesters and similar materials which can be heat-fused at temperatures generally above about 40°C. Moreover, additives usually are dispersed in the polymer material. These additives can include one or more colorant agents such as pigments and dyestuffs which make the developed charge pattern visible. Also desirable as additives are ionic compounds which help to maintain a uniform, stable, high net electrical charge on the triboelectrically charged toner particles. These latter compounds are known as charge control agents or change enhancing additives.

During the development step of an electrostatographic process, the toner particles become triboelectrically charged by frictional contact with the carrier particles. A charge control agent or charge enhancing additive improves the charge uniformity of a toner composition, that is, they insure that substantially all of the individual toner particles exhibit a triboelectric charge of the same sign (negative or positive) with respect to a given carrier; they increase the net electrical charge of the toner particles relative to a given carrier vehicle.

Numerous charge enhancing additives have been proposed for electrostatographic toner compositions. For example, U.S. Pat. No. 4,490,455, which issued to Hoffend, et al. on Dec. 25, 1984, teaches various amine acid salts such as stearyl dimethyl amine tosylate, lauryl dimethyl amine tosylate, and octyl dimethyl amine tosylate may be used as charge enhancing additives for toner compositions.

U.S. patent No. 4,323,634, which issued to Jadwin on Apr. 6, 1982, teaches that quaternary ammonium salt surfactants comprising at least one amido group having 10 or more carbon atoms attached to the ammonium cation and an anion selected from a halide ion or an organosulfur-containing anion may be used as a charge control agent.

U.S. Pat. No. 4,291,112, which issued to Lu on Sept. 22, 1981, teaches using colorant materials treated with a nitrogen-containing organic compound (i.e., quaternary ammonium salts, amines, amides, and alkyl pyridinium compounds) in toner compositions. The patent discloses that these nitrogen-containing organic compounds control both the polarity of charge as well as the magnitude of the charge of the toner.

U.S. Pat. Nos. 4,683,188, and 4,780,553, which issued to Suzuki, et al. on July 28, 1987 and Oct. 29, 1988, respectively, teach that certain quaternary ammonium salts, having a molybdic acid anion, a tungstic acid anion, or a heteropolyacid anion containing molybdenum or tungsten atoms may be used as charge control agents for electrostatic toners.

Other well-known charge control agents include nigrosine salts and organic salts such as cetyl pyridinium chloride and the like.

It has been found that nigrosine salts when used as charge control agents in toners have the disadvantage of decreasing the adhesion of the toner particles to paper.

Likewise, anionic charge control agents, such as those containing stearic acid moieties, do not impart a high net positive electrical charge to the toner particles when in the presence of the magnetic carrier particle. Also, non- surfactant, short-chain quaternary ammonium salts and alkoxylated amines, when used as charge control agents, provide high uniform net electrical charges, but are not as effective when the humidity of their operating environment is varied considerably. Still further, known charge control agents made from quaternary ammonium salts, having at least one long chain amido group attached to the ammonium cation, do maintain a high stable charge in a toner over a wide range of relative humidity; but the quantity of the charge with them depends upon the particular polymers or other ingredients also present in the toner composition.

While these and other charge enhancing additives are suitable for their intended purposes, there still exists a need for toners containing a charge enhancing additive which maintain a uniform, stable high net electrical charge on toner particles without substantially adversely affecting adhesion of the toner to paper as well as being able to operate over a wide range of relative humidities. The present invention is believed to meet that need.

Accordingly, the present invention provides for toner composition comprised of resin particles, colorant agent, and an effective charge controlling amount of at least one charge enhancing additive of the formula (I):

$$R_4-\underset{\underset{O}{\|}}{C}-NH-R_3-\underset{\underset{R_2}{|}}{N}-R_1 \qquad (I)$$

wherein $R_1$ and $R_2$ have lower alkyl groups having 1 to 4 carbon atoms; $R_3$ is a straight-chain alkylene group from 1 to about 8 carbon atoms; and $R_4$ is an alkyl group having from about 7 to about 24 carbon atoms.

The toners of the present invention may also contain other conventional toner components including plasticizers, lubricants, flow control agents, magnetic additives, additional charge control agents and like materials, and are adapted to be mixed with metallic or nonmetallic carrier particles to produce electrostatographic developer compositions.

The toners of the present invention are resistant to smearing after fusion onto a suitable substrate, provide good adhesion of the fused image to the substrate, and provide a uniform, stable, high net electrical charge on toner particles and work over a wide range of relative humidity.

The toner compositions of present invention contain three critical ingredients: at least one charge control agent of formula (I) above; at least one resin, and at least one colorant material.

The preferred charge control agent agents of formula (I) are those where $R_1$ and $R_2$ are individually selected from either methyl or ethyl; $R_3$ is a straight-chained alkylene having 2 to 5 carbon atoms; and $R_4$ is an alkyl group having about 10 to 20 carbon atoms. The most preferred charge control agent agent within the scope of formula (I) is where $R_1$ and $R_2$ are both methyl; $R_3$ is a trimethylene group (i.e., $—CH_2—CH_2—$) and $R_4$ is a stearyl group (i.e., $—C_{17}H_{35}$). This compound is known as stearylamidopropyl dimethylamine and is sold commerically as CYCLOMIDE SODI by Alcolac, Inc. of Baltimore, MD. This surfactant-type amine compound has previously been used as an emulsifier.

In the toner compositions of the present invention, it has been found desirable to employ an amount of charge enhancing additive within the range of 0.01 to 5 weight percent and preferably 1 to 3 weight percent based on the total weight of the particulate toner composition. If much lower amounts are used, the charge control agent provides little or no effect. If much higher amounts are used, the net charge of the toner becomes unstable and is substantially reduced. The optimum amount will depend on the components selected for the particular toner composition and their respective amounts.

The resin component of the toner compositions of the present invention is preferably a mixture of cross-linked vinyl aromatic copolymers, one of which has a gel content of greater than 15% up to about 50%, the other of which has a gel content of greater than 50% up to about 99%, said copolymers having respective gel contents which differ by at least about 10% and said copolymers being present in a weight ratio with respect to one another ranging from about 10:90 to about 90:10.

These preferred cross-linked polymeric material include copolymers and terpolymers containing at least about 40% by weight of one or more monovinyl aromatic compounds such as styrene; the halogenated styrenes such as mono- and dichlorostyrene; the alkyl styrenes such as the methylstyrenes, alpha-methyl styrene, dimethylstyrene, diethyl styrene, isopropyl styrene and the mixed alkylstyrenes; vinyl- naphthalenes; methylvinylnaphthalene, their halogenated derivatives, and mixtures of two or more of such monomers.

In addition to the monovinyl aromatic monomer, these cross-linked copolymers and terpolymers preferably contain from about 5% to about 60% by weight of one or more vinylaryl or vinylalkyl acids or acid derivatives having vinyl or functional groups capable of undergoing covalent cross-linking with suitable cross-linking agents. Illustrative of such monomers are acrylic acid, and the alpha-alkyl substituted acrylic acids such as methacrylic acid, and esters of such acids with aliphatic alcohols; the amides of acrylic and methacrylic acids and derivatives thereof such as the methacrylamides, acrylamides, N-methylacrylamides, N,N-diethylacrylamide, N-ethylmethacrylamide, N,N-dimethylmethacrylamide; the nitriles such as acrylonitrile, methacrylonitrile, ethylacrylonitrile, chloroacrylonitrile, and other nitriles; the alkyl esters of alpha-ethylenic aliphatic dicarboxylic acids such as ethyl fumarate, ethyl maleate diethyl fumarate and diethyl itaconate; the unsaturated ketones, methyl vinyl ketone and methyl isopropenyl ketone, the vinylpyridines; the vinylquinolines; vinylfurane; vinylcarbazoles; the esters of vinyl alcohols such as vinyl acetate; acyl-amino substituted acrylic and methacrylic acids, the ethers of olefinic alcohols, especially the ethers of vinyl and allyl-type alcohols such as vinyl ethyl ether, vinyl butyl ether, vinyl tolyl ether, divinyl ether, methyl isopropenyl ether, methallyl ethyl ether, the unsaturated aldehydes such as acrolein and methacrolein; copolymerizable alkenyl chlorides including methallyl chloride, allyl chloride, vinyl chloride, vinylidene chloride, 1-chloro-1-fluoroethylene, and 4-chlorobutene-1; and the vinylindenes.

Typical copolymers and terpolymers which are especially useful in the present invention are prepared from blends of from about 40% to about 95% by weight styrene, from about 5% to about 60% by weight of acrylic or methacrylic acid or lower alkyl acrylates or methacrylates thereof having from 1 to about 4 carbon atoms in the alkyl moiety such as methyl, ethyl, isopropyl, butyl, and the like, or from about 5% to about 60% by weight of a higher alkyl acrylate or methacrylate having from about 6 to about 20 or more carbon atoms in the alkyl group such as ethylhexyl acrylate or methacrylate, or mixtures thereof. The most preferred copolymers are copolymers and terpolymers based on from about 50% to about 90% by weight vinyl aromatic monomer such as styrene and from about 10% to about 50% by weight of an acrylic or methacrylic monomer such as n-butyl acrylate, methyl methacrylate, n-butyl methacrylate, 2-ethylhexylacrylate, and mixtures thereof.

The preferred vinyl aromatic copolymers used as the resin component of the present toners composition are cross-linked with a suitable cross-linking agent. The cross-linking agents useful for this invention include resinous cross-linkers such as melamine or urea formaldehyde resins or monomeric cross-linkers containing two or more ethylenically unsaturated groups such as divinylbenzene; allyl-containing compounds such as triallyl cyanurate and N,N-diallylmelamine; mixed allyl-vinyl compounds such as allyl acrylate, vinylidene compounds such as diethylene glycol diacrylate and ethylene glycol dimethacrylate; mixed allylvinylidene compounds such as allyl methacrylate; and mixed vinylvinylidene compounds such as mixed esters prepared from ethylene glycol and acrYlic and methacrylic acids. Other useful cross-linking compounds include the following: polyvinyl aromatic compounds, for example, divinylbenzene, divinyltoluene, divinylxylene, divinylethylbenzene, trivinylbenzene, divinylnaphthalene, divinYlmethylnaphthalenes; the cross-linking vinyl esters, allyl esters, and vinyl allyl esters of carboxylic and polycarboxylic acids including polymerizable ester monomers such as diallyl maleate, vinyl crotonate, divinyl succinate, divinyl adipate, vinyl acrylate, vinyl methacrylate; the aliphatic acetylenes such as vinylacetylene, and alpha-methyl vinylacetylene.

The amount of cross-linking agent employed in the preferred cross-linked copolymer resins may vary substantially depending on the number of ethylenically unsaturated groups present in the compound, the reactivity of a specific cross-linking agent with a particular copolymer material, and the molecular weight of the particular cross-linking compound and copolymer material employed. Typically, amounts of cross-linking agent should be at least about 0.01 weight percent, preferably from about 0.01 to about 5 weight percent, based on the total dry weight of the cross-linking agents blended with the copolymer binder materials.

The copolymers may be prepared by any suitable process such as emulsion polymerization or a combination of emulsion and suspension polymerization such as disclosed in U.S. Pat. Nos. 3,938,992 and 4,652,511. Generally, the mixture of monomers and cross-linking agent or agents are dispersed into an aqueous medium containing an emulsifying agent, free radical catalyst such as azobisisobutyronitrile and a molecular weight regulating agent, and this mixture heated to about 60–90°C. for a period of about 1 to 15 hours. Cross-linking normally occurs during polymerization. In suspension polymerization, an emulsion prepolymer prepared as above is dispersed in water, with or without the inclusion of additional monomer, using a dispersing agent such as hydrolyzed polyvinylalcohol or hydrolyzed polymethylmethyacrylate to hold the suspension, and polymerization continued.

As indicated above, the toner of the present invention preferably contains a mixture of cross-linked vinyl aromatic copolymers prepared as described above, one of which has gel content of greater than 15 up to about 50% and the other of which has a gel content of greater than 50% up to about 99%. Preferably, the gel content of the vinyl aromatic copolymers differs by at least 10%, more preferably by at least 20%. Gel content may be controlled during polymerization largely as a function of the type and content of cross-linking agent used, initiator used, and the duration of the polymerization reaction, e.g., the higher the content of cross-linking agent and the longer the time of polymerization, generally, the higher the gel content. The skilled polymerization chemist can readily determine the degree of polymerization and the amount of cross-linking agent required to provide gel contents within the parameters herein given. In general, the molecular weight of the copolymers ranges from about 10,000 to 1,000,000 as measured by gel permeation chromotography.

The gel content of the copolymers is a ratio of the polymer portion which is insoluble in a solvent as a result of cross-linking and is defined as follows:

$$\text{Gel content} = \frac{W_3 - W_1}{W_2 - W_1} \times 100\%$$

wherein a sample of a particulate polymer (generally from 0.5 to 1 g.) is placed in an 80 mesh wire screen having a weight ($W_1$) in grams and the total weight (polymer and screen) is established ($W_2$) in grams, and then soaked in toluene at 20°C. for 48 hours, followed by removal of the screen, drying and weighing ($W_3$) the soaked polymer alone in grams.

The most preferred cross-linked copolymers of the present invention have a softening temperature within the range of from about 40°C. to about 200°C. so that the resultant toner particles can readily be fused to conventional receiving sheets to form a permanent image. Especially useful cross-linked binders are those having a softening temperature within the range of from about 40°C. to about 65°C. because toners containing these binders may be used in high speed electrographic copy machines employing plain paper as the receiving sheet to which the toned images are fused. Of course, where other types of receiving elements are used, for example, synthetic high melting point polymeric sheets, metallic sheets, and the like, cross-linked polymers having a softening temperature higher than the values specified may be used.

As used herein the term "softening temperature" refers to the softening temperature of a polymer as measured by E.I. dupont de Nemours Model 941 TMA (Thermal Mechanical Analyzer) apparatus using a probe pressure of 48 p.s.i.a. and a heating rate of 5°C./minute.

The relative proportions in which the higher gel content and lower gel content copolymers of this invention are mixed generally ranges from about 10:90 to 90:10, more preferably from 25:75 to 75:25 by weight.

Suitable commercially available cross-linked vinyl aromatic polymer which may be used in the present invention are low gel copolymers of 80% by weight styrene and 20% by weight n-butyl acrylate such as are available from polytribo Corporation under the designations ZSR-1002 (25% gel), ZSR-1005 (25% gel), and ZSR-1007 (25% gel). An example of a higher gel copolymer useful for preparing the copolymer blends is Goodyear pliolite AC-4 which is composed of a terpolymer of 50 parts styrene, 30 parts butyl methacrylate, and 20 parts 2-ethylhexyl acrylate and has a gel content of 90%. Other suitable higher gel content polymers include Hercules Res D-277 and D-71, and other polymers such as disclosed in U.S. Pat. No. 4,806,635 to the Hercules Corporation and Nippon ZEON S-111 and S-103. The latter resin is made from 75% by weight styrene, 20% by weight n-butyl acrylate, and 5% acrylonitrile and is cross-linked with divinylbenzene and has a gel content of about 70–90% by weight.

Advantageously, these cross-linked fusible binder resins comprise 25% by weight or more of the toner particles used in the invention. In accordance with preferred embodiments of the invention where the toner particles of the invention are to be used in relatively high speed office copy devices, it has been found advantageous to use toner particles comprising at least 50% by weight, and preferably 50–95% by weight of the cross-linked mixed polymer described above.

A variety of colorant materials selected from dyestuffs or pigments or both are advantageously employed in the toner materials of the present invention. Such materials serve to color the toner and/or render it more visible. The colorants used can, in principle, be selected from virtually any of the compounds mentioned in the Color Index, Volumes 1 and 2, Second Edition.

Included among the vast number of useful colorants would be such materials as Hansa Yellow G (C.L. 11680), Nigrosine Spirit Soluble (C.I. 50415), Chromogen Black ETOO (C.I. 45170), Solvent Black 3 (C.I. 26150), Fuchsine N (C.I. 42510), C.I. Basic Blue 9 (C.I.

52015), and the like. Carbon black provides a particularly useful colorant. The amount of colorant added may vary over a wide range, for example, from about 1% to about 20% of the weight of the total toner. Particularly good results are obtained when the amount is from about 2% to about 10% by weight of the toner.

When the toner of the present invention is to be used for Magnetic Image Character Recognition (MICR) applications, then finely divided magnetic particles such as gamma iron oxide or magnetite or ferrite materials may be included in the toner composition and at a level of from about 1% to about 60% by weight based on the total toner weight. Examples of suitable materials include commercially available acicular magnetites and cubical magnetites. Preferred magnetites are acicular magnetites such as available from pfizer under the designation MD 4131 and MO 4232, and cubical magnetites such as MO 7029, or circular magnetites from Magnox such as Magnox B-353. Other useful magnetites are Mapico Black available from Cities Service Company, and polyhedral magnetites available from Hercules Corporation as Ex 1601 and XMT 100. The preferred level of magnetite addition for the purposes of this invention is from about 10% to about 40% by weight based on the weight of the toner.

The toner composition of this invention may also contain other polymeric components in addition to the cross-linked vinyl aromatic copolymers. Examples of such other polymeric components include smear inhibitors such as polyvinylbutyral resins and epoxy resins which tend to improve the smear resistant properties of the toner, and polymeric lubricants such as low molecular weight polyolefins, including oxidized and non-oxidized polyethylene or polypropylene which aid in the toners penetration of the substrate (e.g., paper). Other polymeric additives which may be included are silicone resins, polyvinylchloride, polyvinylacetate, polyesters, polyurethanes. polyamides, rosins, terpene resins, paraffin waxes, and the like. These classes of additives are generally each incorporated at a level of from about 0.05% to about 15% by weight, based on the total toner weight.

The toner composition may also advantageously contain flow control agents such as polyvinylidene fluoride powder, or a finely divided silica or alumina powder. The silica fine powder may include anhydrous silicon dioxide and also silicates such as aluminum silicate, sodium silicate, potassium silicate, magnesium silicate, and zinc silicate. The amount of such flow control additives added to the toner composition generally ranges from about 0.5% to about 5.0% by weight, based on the total toner weight.

A convenient method for preparing the toner is melt blending. This involves melting the binder polymer and mixing it with the colorant materials such as dyes or pigments and the other additives on heated compounding rolls. After thorough blending, the mixture is cooled and solidified. The solid mass is broken into small particles and finely ground to form a free-flowing power of toner particles which may then be further screened to remove large particles.

Particles of mean diameter between 0.1 micron and 100 microns may be used, although present day office copying machines employ particles of mean diameter between 1 to 30 microns. Larger or smaller particles can be used for particular methods of development. For example, in powder cloud development, such as described in U.S. Pat. No. 2,691,345, extremely small toner particles can be used.

The toners of this invention normally are mixed with a carrier to form a developer composition. In addition, magnetic carrier particles can be used. Suitable magnetic carrier materials include ferromagnetic materials such as iron, cobalt, nickel, alloys, and mixtures thereof, preferably steel shot.

In developers for use in magnetic brush development, the carrier preferably comprises ferromagnetic particles overcoated with a thin or discontinuous layer of film-forming resin, for example, a fluorocarbon polymer such as polytetra- fluoroethylene, polyvinylidene fluoride, or a copolymer of vinylidene fluoride and tetrafluoroethylene or an alkali- soluble carboxylated polymer as described in Miller U.S. Pat. No. 3,547,822. Other useful resin-coated magnetic carrier particles are described in Miller U.S. Pat. No. 3,632,512, McCabe U.S. Pat. No. 3,795,617, and Kasper U.S. Pat. No. 3,795,618. preferably, the carrier comprises an iron or steel core which has been subjected to high temperature oxidation treatment in a fluidized bed as described in U.S. Pat. No. 3,767,477 to form a high resistant, durable, iron oxide layer thereon, followed by treatment of the resulting iron oxide-coated core in the bed with an inert atmosphere at elevated temperatures while a coating of a fluoropolymer layer is applied thereover. The resultant carrier may be preconditioned as described in Olsen, et al. U.S. Pat. No. 3,970,571, at least a portion of the toner removed and fresh toner added thereto before use.

A typical developer composition containing the described toner and carrier particles comprises from about 1% to about 10% by weight of toner particles. The carrier particles can have a particle size of from about 30 to about 1,200 microns, preferably 60–300 microns, and thus usually are larger than the toner particles. Developer compositions of the invention can also, however, employ smaller carrier particles, including those which are of about the same size as the toner particles, e.g., of 1 to 30 microns average diameter.

Developable charge patterns can be prepared by a number of well-known means and be carried, for example, on a light-sensitive photoconductive element or a nonlight sensitive dielectric-surfaced receiving element. Suitable dry development processes include cascading a developer composition across the electrostatic charge pattern as described in detail in U.S. Pat. Nos. 2,618,551; 2,618,552; and 2,638,416. Another process involves applying toner particles from a magnetic brush developer composition as described in U.S. Pat. No. 3,003,462. Still another useful development process is powder-cloud development wherein a gaseous medium such as air is utilized as a carrier vehicle to transport the toner particles to the electrostatic charge pattern to be developed. This development process is more fully described in U.S. Pat. Nos. 2,691,345 and 2,725,304. Yet another development process is for brush development wherein the bristles of a brush are used to transport the toner particles to the electrostatic charge pattern to be developed. This development process is more fully described in Walkup, U.S. Pat. No. 3,251,706.

As will be apparent from the above discussion, the improved electrographic development process of the present invention using the toner particles described herein can employ various types of carrier vehicles ranging from the conventional inorganic particles used in cascade development and metallic particles used in magnetic brush development to gaseous media and fur brushes used in powder cloud and fur brush development, respectively.

After deposition of the toner particles in accordance with the process of the invention, the image can be fused as described earlier herein to adhere it to the substrate bearing the toner image. Radiant heaters or heated fuser rolls may be employed to provide fusion heat. If desired, the unfused image can be transferred to another support such as a blank sheet of copy paper and then fused to form a permanent image thereon.

The following examples are included for a further understanding of this invention. All parts and percentages are by weight unless explicitly stated otherwise.

EXAMPLE

PREPARATION OF TONER

The following dry ingredients were premixed in a container:

| Ingredients | Parts by Weight |
|---|---|
| 80% Styrene/20% Butyl Acrylate Copolymer (20-30% gel content)[1] | 41.0 |
| 75% Styrene/20% Butyl Acrylate 5% Acrylonitrile Copolymer (70-90% gel content)[2] | 41.0 |
| Carbon Black[3] | 7.5 |
| Polypropylene (nonoxidized)[4] | 3.0 |
| Polypropylene (oxidized)[5] | 1.0 |
| Epoxy Resin[6] | 4.0 |
| Stearylamidopropyl Dimethylamine[7] | 2.5 |
| | 100.0 |

[1]ACRYBASE ZSR-1005 available from Polytribo, Inc. of Philadelphia, PA.
[2]S103 available from Nippon Zeon Co., Ltd. of Tokyo, Japan.
[3]Regal 330R available from Cabot Corp. of Boston, Ma.
[4]Viscol 550-P available from Sanyo Chemical Industries, Ltd., of Kyoto, Japan.
[5]Viscol TS-200 available from Sanyo Chemical Industries, Ltd. of Kyoto, Japan.
[6]EPON 1007F available from Shell Oil Company of Houston, TX.
[7]CYCLOMIDE SODI available from Alcolac Inc. of Baltimore, MD.

After the ingredients were thoroughly mixed, the mixture was added to a Banbury mixer and compounded therein for about 5 minutes. During this compounding, the mixture temperature raised up to 200°F.-250°F. because of the shearing forces in the mixer.

After this Banbury compounding step, the resulting molten mixture was added to a two-roll mill for further mixing. The mixture was passed through the two-roll mill ten times at a gap setting of 35 mils. The resulting slab-like mixture was then cooled to room temperature and then coarse-crushed by passing through a Fitz mill. This was followed by further pulverization by passing through a Sturtevant micronizer and Donaldson Classifier Acucut Model A-12. The resulting toner sample had its particle size distribution measured in a Coulter Counter. The measured mean particle size was 7.97 microns. The toner contained 12.2% by number of particles smaller than 5.04 microns and 1.8% by number of particles greater than 20.2 microns.

PREPARATION OF DEVELOPER

Three parts of the above toner were mixed with 100 parts by weight of an oxidized Hoeganaes EH sponge iron particles (particle size range of 100-200 microns) coated with KYNAR fluorocarbon resin in a Twin Shell Blender for 15 minutes. Then the resulting developer was machine print tested in a Siemens 2200 laser printer having a floating development station. Before and during this machine testing, the resistance (ohm), Tribo (μC/g) and toner concentration in the developer (% by weight) were measured. These results are shown in Table I below.

MACHINE TESTING RESULTS

The resistance data shown below is the developer nip resistance measured in this laser printer by using a stationary electrode on the bare aluminum developer drum in the printer. The developer nip resistance should stay relatively stable through the operation of the printer. If the developer nip resistance varies considerably, an undesirable background will appear in the printed image or the printed image will appear less dense. The "relative stable resistance" will vary from printer-to-printer. For the Siemens 2200 laser printer, the variance of resistance should be less than 1.4 units (i.e., log of the maximum operating resistance minus the log of the minimum operating resistance should be less than 1.4).

Tribo (or Q/M or triboelectric charge per mass) is the measure of the charge remaining on a toner particle after being activated by a carrier particle. Tribo was measured by the Faraday Cage "blow-off" technique as described in U.S. Pat. No. 3,526,533. Most laser printers have a Tribo operating window of from about −10 to about −30 μC/gram of toner at a toner concentration range from about 1-3% by weight.

TABLE I

| Print Count | Resistance (Ohm) | Tribo (μC/g) | Toner Conc. (% by Weight) |
|---|---|---|---|
| 1 | $3.88 \times 10^6$ | −37.7 | 2.66 |
| 18,000 | $1.34 \times 10^6$ | −29.2 | 2.68 |
| 30,000 | $1.33 \times 10^6$ | −26.2 | 2.78 |
| 45,000 | $1.4 \times 10^6$ | −28.5 | 2.76 |
| 60,000 | $1.2 \times 10^6$ | −22.3 | 2.88 |
| 75,000 | $1.53 \times 10^6$ | −23.1 | 2.70 |
| 90,000 | $1.9 \times 10^6$ | −25.2 | 2.68 |
| 120,000 | $2.82 \times 10^6$ | −24.2 | 2.99 |
| 150,000 | $4.46 \times 10^6$ | −20.3 | 2.76 |

These results indicate that developer resistance and Tribo were relatively stable during a machine test of 150,000 print copies made on this particular laser printer. Specifically, the resistance varied only 0.57 units (i.e., log of $4.46 \times 10^6$ minus log of $1.2 \times 10^6 = 6.65 - 6.08 = 0.57$). Also, the Tribo varied only −29.2 to −20.3 μC./gram since the initial −37.7 μC./gram measurement may be disregarded as being part of the run-in period for this printer.

These test results were also in the same range of resistance and Tribo values for a similar developer containing the same percentages of the above-noted toner ingredients, except for the charge control agent. That similar developer instead employed Hodogaya TP-415 as the charge control agent.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A toner composition comprised of resin particles, colorant material and an effective charge controlling amount of at least one charge enhancing additive of the formula:

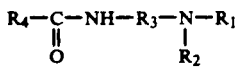

wherein $R_1$ and $R_2$ are lower alkyl groups having 1 to 4 carbon atoms; $R_3$ is a straight-chain alkylene group having from 1 to about 8 carbon atoms; and $R_4$ is an alkyl group having from about 7 to about 24 carbon atoms.

2. The toner composition of claim 1 wherein $R_1$ and $R_2$ are either methyl or ethyl; $R_3$ is a straight-chained alkylene having 2 to 5 carbon atoms; and $R_4$ is alkyl group having about 10 to about 20 carbon atoms.

3. The toner composition of claim 2 wherein $R_1$ and $R_2$ are both methyl; $R_3$ is a trimethylene group; and $R_4$ is a stearyl group.

4. The toner composition of claim 1 wherein said resin particles are a mixture of cross-linked vinyl aromatic copolymers, one of which has a gel content of greater than 15% up to about 50%, the other of which has a gel content of greater than 50% up to about 99%, said copolymers having respective gel contents which differ by at least about 10%, and said copolymer being present in a weight ratio with respect to one another ranging from about 10:90 to about 90:10.

5. The composition of claim 4 wherein said copolymers comprise at least about 40% by weight of vinyl aromatic monomer and the balance one or more ethylenically unsaturated monomers selected from the group consisting of acrylic acid, methacrylic acid, derivatives thereof, and mixtures thereof.

6. The composition of claim 5 wherein said vinyl aromatic monomer is styrene.

7. The composition of claim 5 wherein said one or more ethylenically unsaturated monomers are selected from the group consisting of $C_1$ to $C_{20}$ alkyl acrylates and methacrylates, and mixtures thereof.

8. The composition of claim 5 containing at from about 50% to about 90% by weight of polymerized styrene and from about 10% to about 50% by weight of one or more polymerized acrylic or methacrylic monomers.

9. The composition of claim 5 wherein one of said cross-linked vinyl aromatic copolymers has a gel content of from about 20% to about 30% and another of said cross-linked vinyl aromatic copolymers has a gel content of from about 70% to about 90%.

10. The composition of claim 9 wherein said acrylic monomer in both cross-linked copolymers is butyl acrylate.

11. The composition of claim 1 wherein said charge enhancing additive is present at a level of from about 0.01% to about 5% by weight of said toner composition.

12. The composition of claim 1 wherein said cross-linked vinyl aromatic copolymers are present at a level of from about 50% to about 95% by weight of said toner composition.

13. The composition of claim 1 further containing an anti-smear agent selected from the group consisting of an epoxy resin and a polyvinylbutyral resin present at a level of from about 0.05% to about 15% by weight of said toner composition.

14. The composition of claim 2 further containing a flow control agent present at a level of from about 0.5% to about 5% by weight.

15. The composition of claim 14 wherein said flow control agent is finely divided silica.

16. A developer composition comprising toner composition of claim 1 mixed with carrier particles, said developer containing from about 1% to about 10% by weight of said toner particles.

17. The developer of claim 16 wherein said carrier particles are ferromagnetic particles.

18. A process for generating documents which comprises providing the document desired, imprinting characters thereon by electrostatographic methods, and developing the characters with the developer composition of claim 16.

* * * * *